United States Patent [19]

Hsu

[11] Patent Number: 4,503,422

[45] Date of Patent: Mar. 5, 1985

[54] COMPOSITE LOCKING DEVICE

[76] Inventor: Chih-Min Hsu, 2-6th Fl., 13 La. 118, Chung Ching S. Rd., Sec. 1, Taipei, Taiwan, 100

[21] Appl. No.: 338,685

[22] Filed: Jan. 11, 1982

[51] Int. Cl.[3] ..... G08B 13/08

[52] U.S. Cl. ..... 340/543; 70/284

[58] Field of Search ..... 340/543, 542; 70/284, 70/283, 416, DIG. 49, DIG. 71

[56] References Cited

U.S. PATENT DOCUMENTS

| | | | |
|---|---|---|---|
| 3,858,193 | 12/1974 | Bach | 340/543 |
| 4,030,071 | 6/1977 | Barker | 340/543 |
| 4,064,721 | 12/1977 | Morgan | 70/416 |
| 4,095,239 | 6/1978 | Gerry | 340/543 |
| 4,333,074 | 6/1982 | Sutherland et al. | 340/543 |

*Primary Examiner*—Glen R. Swann, III

[57] ABSTRACT

A composite locking device comprises a case frame adapted to be connected to the inside of a door and a lock lever within the case frame. The lock lever is capable of lateral movement and has a first end which extends through the opening in the case frame to be received in a recess in a door jamb, and a second end within the case frame. The case frame includes a rotatable disk which is adapted to receive a key for laterally displacing the lock lever. A lockhead is fastened adjacent to the disk so that the key passes therethrough before it is received by the rotatable disk. The lockhead includes a power switch which is activated by insertion of the key, the power switch in turn activating a code switch. The code switch activates an electromagnet. A lock bolt is provided in the case frame which engages the lock lever. When the electromagnet is activated, it attracts the lock bolt away from the lock lever thus permitting lateral displacement of the lock lever by the key without activating an alarm. The improper opening of the locking device will thus cause the activation of an alarm providing a warning that an unauthorized entry is being attempted.

3 Claims, 3 Drawing Figures

COMPOSITE LOCKING DEVICE

BACKGROUND OF THE INVENTION

This invention relates to composite locking devices.

The lock is an indispensable household item of vital importance in the safe keeping of privately owned property. Room locks generally require simple construction. However, locks for installation onto gate doors for use as gate locks require a more complicated mechanism. Most gate door locks are designed primarily to protect against unwanted attempts to unlock from outdoors. The present invention provides for a locking device that can serve to prevent break-in and eventual break-out of unlawful intruders at the same time.

SUMMARY OF THE INVENTION

This invention provides for a composite locking device possessing both mechanical and electronic locking capacities. The electronic locking portion of the composite lock is operated by inserting code numbers and it is possible to effect a change of code numbers of the electronic locking system.

The mechanical lock includes a bolt core movable for two shifts (i.e., two discontinuous lateral displacements in the same direction) by a key inserted into the lock from the outside, whereas turning of a knob indoors can move the core only one shift. An additional bolting latch provided on the indoor side protects against illegal attempts to unlock the door from outdoors. The lock includes a circuit comprising a coded switch and an electromagnetic bolt with the capacity to change the code number of the circuit network when desired. The electromagnetic bolt will react to turn on an alarm in the event of unwanted attempts to break in.

The invention thus provides a systematic power driven code-variable gate lock with alarm features.

The present invention comprises a composite locking device that consists of a mechanical lock and electronic circuit lock with an alarm network provided therefor. Adjacent the mechanical lock there is provided a lockhead outside the gate that will receive a given key and activate a circuit switch. The key thereafter enters a rotatable disk which will rotate to push the lock lever by two shifts. The lock lever can be pushed for one shift by the action of a lock knob provided on the indoor side. A bolting latch is provided to prevent attempts to unlock the door from the outside.

The electronic circuit lock comprises an electronic circuit under the control of a coded switch which serves to set an electromagnet at work to lift a lock bolt. The result is that the lock lever and the lock bolt are free from contact with each other to avoid activating the alarm network inadvertently.

DETAILED DESCRIPTION OF THE PREFERRED EMBODIMENT

Figure 1A:
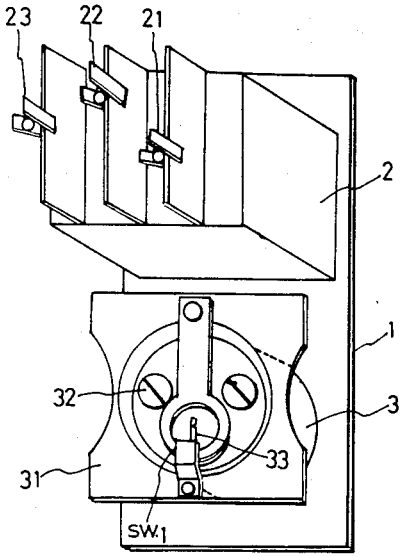
FIG. 1A is a perspective view of a switch and lockhead of the door lock shown in FIG. 1.
Figure 1:
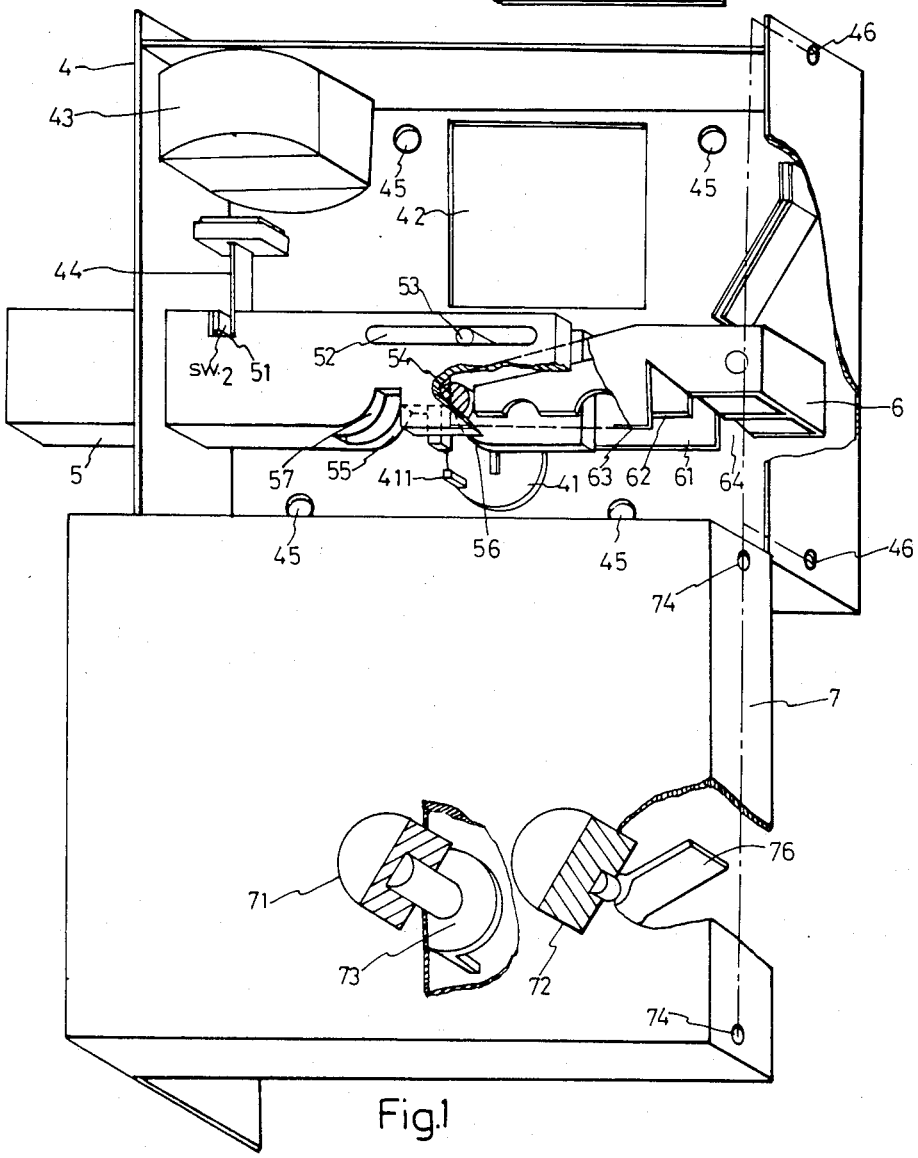
FIG. 1 is a perspective view of part of a door lock of the present invention with the door lock set at the locked position.

Referring to FIGS. 1 and 1A there is shown a front panel 1 of the door lock of the present invention provided with a code switch 2 having clip-like circuit terminals 21, 22, 23. A lockhead 3 is provided beneath the switch 2. The lockhead 3 is fixed to a fixing piece 31 which in turn is fixed to the panel 1 by flat head bolts 32. On the fixing piece 31 there is also provided a lockhead power switch SW1 having a ring terminal of one polarity and a bent and curved terminal of the other polarity.

When passing the tip of a key through the keyhole 33 of the lockhead 3, the lockhead power switch SW1 is first turned on to provide the drive power for the switch 2. The key thereafter enters the rotatable disk 41.

A frame case 4 shaped like a box is provided. Above the disk 41 there is provided a square hole 42. The square hole 42 and disk 41 are both located in the frame case so that the switch 2 and the lockhead 3 respectively are received thereby.

There is provided an electromagnetic body 43, which is controlled by the switch 2. The electromagnetic body 43 will raise a lock bolt 44 so as to prevent the switch SW2 between the lock bolt 44 and the lock lever 5 from being turned on thus avoiding setting the alarm off inadvertently. There is also provided an indoor switch SW3 (shown in FIG. 2) that may be set on the inside of a door.

The lock lever 5 is structured to have one end extendible through the outside of the case frame 4. A slotted opening 52 is provided in the central portion of the lock lever 5 to limit the displacement thereof by means of locking pin 53. On one side of the lock lever 5 there is provided a bolt groove sufficiently large to accommodate the lock bolt 44. The switch SW2 will not be activated unless abnormal operation of the lock is sensed or the door is subjected to unduly applied forces.

The lateral displacement of the lock lever 5 is controlled by a check rail 6. The lock bolt 44 is raised when the electromagnetic 43 is on. Turning of a key will rotate the disk hammer 41 after the lock bolt 44 is raised sufficiently to leave the lock lever free for lateral displacement. The lug 411 on the disk 41 will in turn raise the outshoot 61 of check rail 6 so as lift a middle fixing member 62 to a point higher than a mortise bolt 54 provided in the lock lever 5. The key will thereafter engage the grooves 55 and/or 56 on the lock lever 5 and further rotation of the key will effect lateral displacement of the lock lever 5 by a distance equal to 1 or 2 shifts as the case may be. Thus, there will be a lateral displacement of one shift to the right in FIG. 1 if the key engages groove 56 only and two shifts if the key is further rotated to engage groove 55.

The frame cover 7 includes a lock knob 71 and lock bolt knob 72, the lock knob 71 being fixed to a socket footing 73. The socket footing has a similar function to the disk 41 as described above. However, it will not contact the outshoot 61 while acting to lift the check rail 6 by the flat plate 63 on the opposite side.

It will be noted that the lock lever 5 can be in one of three positions. In a first position, the lever 5 is extended fully, as shown in FIG. 1. Rotation of the key from the outside will cause the key to engage in groove 56 and shift the lever 5 into an intermediate or second position. Further rotation of the key will cause the key to engage in groove 55 and shift the lever into a withdrawn or third position. Whereas the disk 41 is capable of moving the lock lever 5 through two shifts in either direction, the socket footing 73 is only capable of moving the lock lever 5 through one shift, that is, from the second to the third position or vice versa.

The lock bolt knob 72 is connected to a bolt check 76 which may be turned into an inverted groove 64 of the check rail 6 to hold the check rail 6 still under externally imposed forces thus preventing unlocking with a key outdoors.

The installation and operation of the lock will now be described. A square hole and a round hole are drilled in the gate door at a suitable position for the lockhead 3 and the switch 2. The panel 1 is set contiguous to the outer face of the door for locking to the lockhead 3 by the bolts 32, which extend from the fixing piece 31. Bolts are introduced into holes 45 provided in the frame case 4 so that the case frame 4 is fixed on to the gate door with the left edge thereof flush with the left edge of the door sill. The switch 2 and the keyhole 33 and lockhead 3 are aligned with the square hole and the disk 41 respectively in the case frame 4. The frame cover 7 is then fitted to the case frame 4 by bolts passing through the holes 46 and the holes 74.

Figure 2:
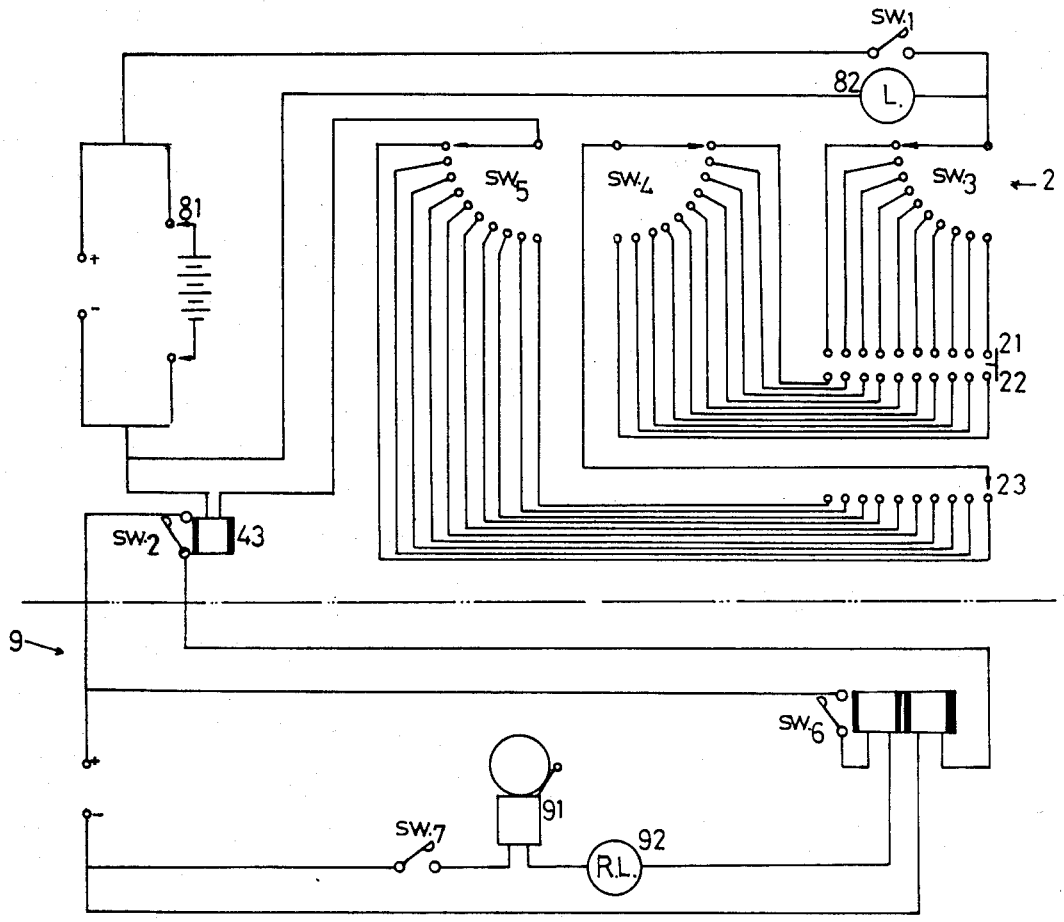
FIG. 2 is a circuit diagram of the present invention utilizing a three piece coded switch.

Referring to FIG. 2 a DC power source of 6 to 12 V is used in the circuit with an auxiliary power unit cell 81 provided in case of power failure. The switch SW1 is controlled by a matching key. A lamp 82 is placed above the switch 2 to facilitate reading of the code number while the proper user proceeds to effect unlocking. The switch 2 is divided into three groups SW3, SW4 and SW5 with the correct code number determined by terminals 21, 22 and 23 respectively. Once the correct code number is inserted the electromagnet 43 will raise the lock bolt 44 to turn off SW2 to avoid setting off the alarm 9.

When electromagnet 43 does not turn off SW2 because of the incorrect choice of a given code number that is covered by the switch 2, subsequent manipulation of the lock lever 5 by turning of an improper key will actuate SW2 which in turn will activate electromagnet SW6. Alarm bells 91, 92 will thereafter release alarm signals that will be emitted continuously as long as SW7 remains working, even if SW2 is subsequently cut off. In this way the concierge or other person will be warned of an attempted unauthorized entry.

From the foregoing it will be noted that the present invention provides a rigidly structured highly efficient lock inclusive of safety features, which has the ability to emit alarm signals when subjected to abnormal manipulations which may occur during break-ins.

What is claimed is:

1. A composite locking device comprising:

a. a case frame adapted for connection to the inside of a door;

b. a lock lever mounted in the case frame and adapted for lateral movement therein, the lock lever having a first end extendible through an opening in the case frame and a second end;

c. a first rotatable disk in the case frame adapted to receive a key for laterally moving the lock lever;

d. a lockhead having a power switch, the lockhead being adjacent to the first disk and through which the key is adapted to be inserted to reach the disk, the power switch being activated by insertion of the key;

e. a code switch activated by the power switch;

f. an electromagnet in the case frame activated by the code switch;

g. a lock bolt movable between a first position where it engages the lock lever and a second position where it is moved off the lock lever, the lock bolt being normally in the first position and moved to the second position by the activation of the electromagnet;

h. an alarm switch which will set off an alarm, the alarm switch being activated when lateral movement of the lock lever occurs while the lock bolt is in the first position;

i. a second rotatable disk within the case frame on the side of the lock lever opposite that of the first disk and serving to laterally move the lock lever when rotated, the second disk being rotated by a lock knob on the case frame; and j. a check piece in the case frame capable of being set to prevent lateral movement of the lock lever.

2. The locking device as claimed in claim 1 wherein the lock lever includes a. a pair of grooves for engagement by the first disk, whereby one rotation of the key will laterally move the lock lever between a first unlocked position to an intermediate locked position and another rotation of the key will move the lock lever from the intermediate locked position to a fully locked position;

b. a single groove for engagement by the second disk, whereby rotation of the second disk causes the lock lever to move between the first unlocked position and the intermediate locked position but is incapable of moving the lock lever between the fully locked position and the intermediate locked position.

3. The locking device as claimed in claim 1 wherein the code switch is programmed to respond to a pre-set code number and whereby the code number may be changed by reprogramming the code switch.

* * * * *